US005263915A

United States Patent [19]

Habing

[11] Patent Number: 5,263,915

[45] Date of Patent: Nov. 23, 1993

[54] EXERCISE METHOD WITH ADJUSTABLE POSITION EXERCISE MEMBERS

[75] Inventor: Theodore G. Habing, Long Beach, Calif.

[73] Assignee: Pacific Fitness Corporation, Cypress, Calif.

[21] Appl. No.: 8,395

[22] Filed: Jan. 25, 1993

Related U.S. Application Data

[63] Continuation of Ser. No. 877,386, Apr. 29, 1992, abandoned, which is a continuation of Ser. No. 565,892, Aug. 9, 1990, abandoned, which is a continuation of Ser. No. 401,010, Aug. 30, 1989, abandoned.

[51] Int. Cl.[5] ..... A63B 21/062

[52] U.S. Cl. ..... 482/99; 482/100; 482/102; 482/138; 482/908

[58] Field of Search ..... 482/93-103, 482/104-108, 133-138, 908

[56] References Cited

U.S. PATENT DOCUMENTS

| | | | |
|---|---|---|---|
| 2,977,120 | 3/1961 | Morris | 482/103 |
| 3,306,611 | 2/1967 | Gaul | 482/102 |
| 3,815,903 | 6/1974 | Blomqvist | 482/102 |
| 4,199,139 | 4/1980 | Mahnke et al. | 272/118 |
| 4,505,475 | 3/1985 | Olschansky et al. | 272/118 |
| 4,657,246 | 4/1987 | Salter | 272/117 |
| 4,809,972 | 3/1989 | Rasmussen et al. | 272/118 |

FOREIGN PATENT DOCUMENTS

| | | | |
|---|---|---|---|
| 7609655 | 3/1978 | Netherlands | 482/102 |
| 1151656 | 5/1969 | United Kingdom | 482/102 |

*Primary Examiner*—Robert Bahr

*Attorney, Agent, or Firm*—Blakely, Sokoloff, Taylor & Zafman

[57] ABSTRACT

An exercise method having one or more exercise members connected by a cable system to a weight, such as a variable weight stack, and each movable by a user along an exercise path to perform an exercise routine against the resisting force of the weight, and a pre-stretch adjustment feature, whereby the position of each exercise member along its exercise path at which the resisting force of the weight commences to act on the member, and hence also the portion of the exercise path over which the resisting force acts on the member, are adustable in order to vary the exercise routine performed with each exercise member.

2 Claims, 4 Drawing Sheets

EXERCISE METHOD WITH ADJUSTABLE POSITION EXERCISE MEMBERS

This is a continuation of Ser. No. 07/877,386 filed Apr. 29, 1992, now abandoned; which is a continuation of Ser. No. 07/565,892 filed Aug. 9, 1990, now abandoned, which is a continuation of Ser. No. 07/401,010 filed Aug. 30, 1989, now abandoned.

BACKGROUND OF THE INVENTION

1. Field of the Invention

This invention relates generally to exercise machines of the class having one or more exercise members connected by a cable system to a weight, such as a variable weight stack, and each movable by a user of the machine along a certain exercise path to perform an exercise routine against the resisting force of the weight. The invention relates more particularly to an exercise machine of this class wherein the position of each exercise member along its exercise path at which the resisting force of the weight commences to act on the member, and hence also the portion of the exercise path over which the resisting force acts on the member, are adustable in order to vary the exercise routine performed with each exercise member.

2. Prior Art

Stated in very general terms, a typical exercise machine of the class to which this invention pertains comprises a frame having one or more exercise stations, a weight, typically a variable weight stack, movable up and down relative to the frame, an exercise member at each exercise station to grasped by a user of the machine and moved relative to the frame in a back and forth exercise motion along a certain exercise path, and a cable system connecting the weight and exercise member(s). This cable system is arranged in such a way that during movement of any exercise member in one direction along its exercise path, a lifting force is transmitted from the member to the weight which raises the weight from a normal lower rest position. During movement of the exercise member in the opposite direction along its exercise path, the weight returns downwardly to its rest position by gravity. The gravitational force on the weight is transmitted through the cable system back to the exercise member to produce on the member a resisting force which resists the exercise motion of the member.

The cable systems used in such exercise machines vary substantially from one machine to another. All of the cable systems, however, have the one common feature of a cable or cables through which the lifting and resistance forces are transmitted between the exercise member(s) and the weight and cable guides or pulleys on the machine frame around which the cable passes. During movement of any exercise member in its exercise motion, the lifting and resistance forces transmitted through the cable system between the exercise member and the weight stress the cable(s) of the cable system in tension.

The prior art is replete with a vast assortment of exercise machines of the general class described. Examples of such machines are found in U.S. Pat. Nos. 4,169,626, 4,199,139, 4,358,108, 4,390,179, 4,456,246, 4,505,475, 4,564,193, 4,634,127, 4,844,456, Great Britian 2,106,339 and West German 3,205,581.

SUMMARY OF THE INVENTION

This invention provides an improved exercise machine of the class described having a frame with one or more exercise stations spaced about the frame to be occupied by a person using the machine. Each exercise station has an exercise member, and the exercise machine has a cable system connecting the exercise member(s) of the machine to a weight which has a lower rest position wherein the weight rests on the machine frame. The cable system is arranged in such a way that weight is movable upwardly from and downwardly to its rest position by a certain back and forth exercise motion of each exercise member along an exercise path. Thus, movement of each exercise member in one direction along its exercise path from its normal position, referred to herein as forward movement of the member, exerts on the weight an upward lifting force which raises the weight from its lower rest postion. The weight, in turn, exerts on the exercise member a gravitational resisting force which resists such forward movement of the exercise member and urges the member rearwardly toward its normal position. Rearward return movement of each exercise member to its normal position lowers the weight to its rest position by the force of gravity. A person using the machine grasps an exercise member and moves the member in its back and forth exercise motion against the resisting force of the weight to perform an exercise routine. A preferred exercise machine according to the invention is a multistation machine having a plurality of exercise stations for performing different exercise routines and is used by only one person at a time.

According to a primary feature of the invention, each exercise member of the improved exercise machine is movable forwardly along its exercise path to a forward limiting position and in the opposite direction along its path to a fixed return limiting position which is referred to herein as the normal position of the member. The machine incorporates a "pre-stretch" adjustment feature for adjusting the position of each exercise member along its exercise path at which the resisting force of the weight commences to act on the member during forward movement of the member from its normal position toward its forward limiting position and thereby the portion of the exercise path over which the resisting force acts on the exercise member. The purpose of this pre-stretcch adjustment of the machine is to enable each individual user of the machine to accomodate the various machine exercises to the user's individual exercise needs, abilities, objectives and the like. The pre-stretch adjustment is accomplished, in effect, by adjusting the cable path of the cable system in such a way as to vary the effective slack in the cable system when each exercise member occupies is normal.

To this end, the cable system of a preferred exercise machine of the invention includes a cable through which the lifting and resisting forces are transmitted between the weight and each exercise member and which is stressed in tension by such forces, and a cable guide, such as a pulley, about which the cable passes. The cable guide is mounted on the machine frame for movement relative to the frame along a direction line such that tension in the cable urges the guide in one direction along the direction line. Adjustment of the cable guide along this direction line when each exercise member occupies its normal position adjusts the slack in the cable and thereby the forward movement of each exercise member along its exercise path from its normal position neccessary to take up or remove the cable slack. The position of each exercise member along its exercise path at which the cable slack is removed is the position at which a lifting force is transmitted from the exercise member to the weight and a resisting force is transmitted from the weight to the exercise member.

As noted above, the preferred exercise machine of the invention is a multistation machine having a plurality of exercise stations for performing different exercise routines. This preferred machine embodies essentially a single common pre-stretch adjustment means for effecting simultaneous pre-stretch adjustment of all the exercise stations of the machine.

DESCRIPTION OF THE PREFERRED EMBODIMENTS

Figure 1:
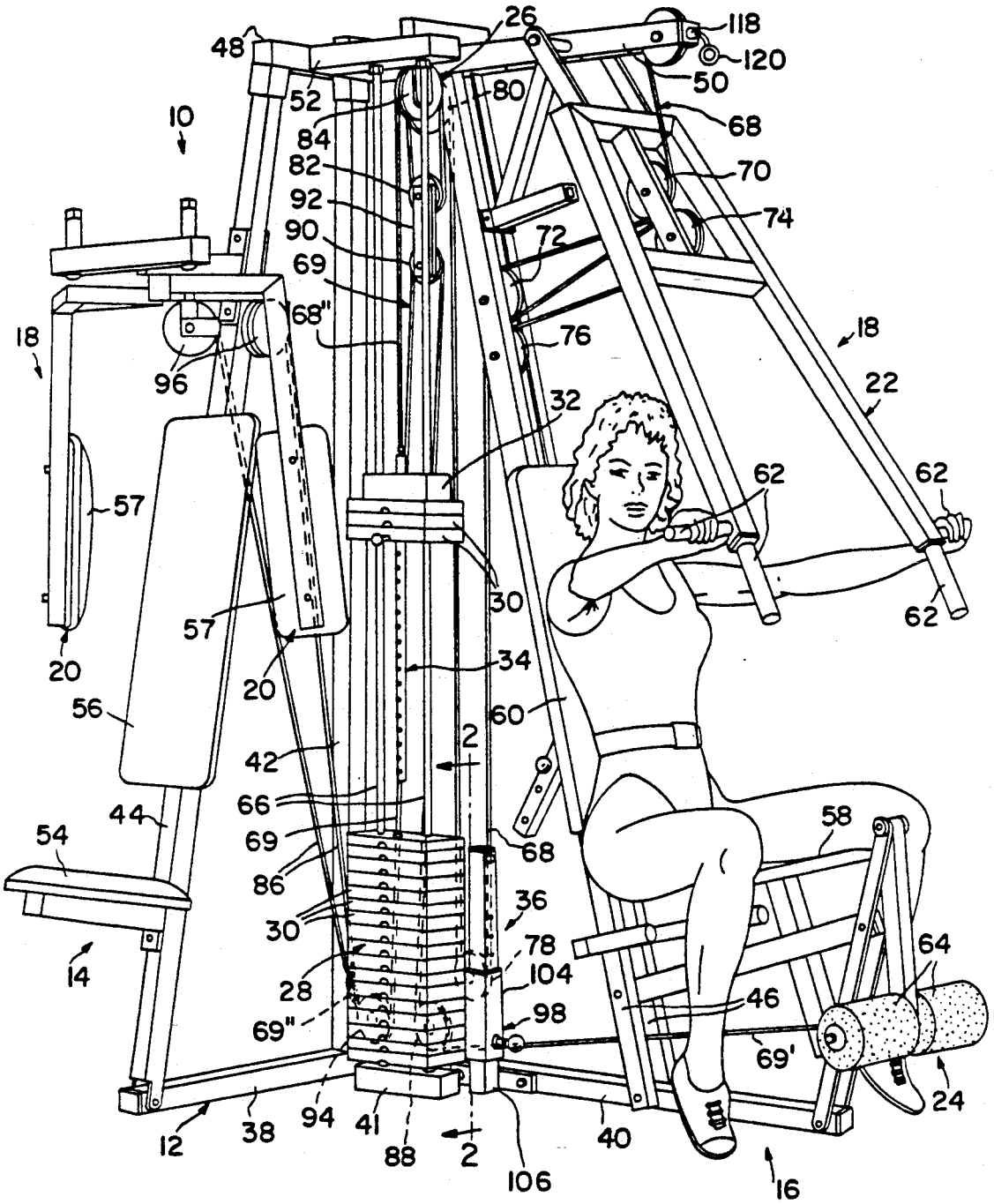
FIG. 1 is a perspective view of a multistation exercise machine embodying the pre-stretch adjustment feature of the invention.
Figure 2:
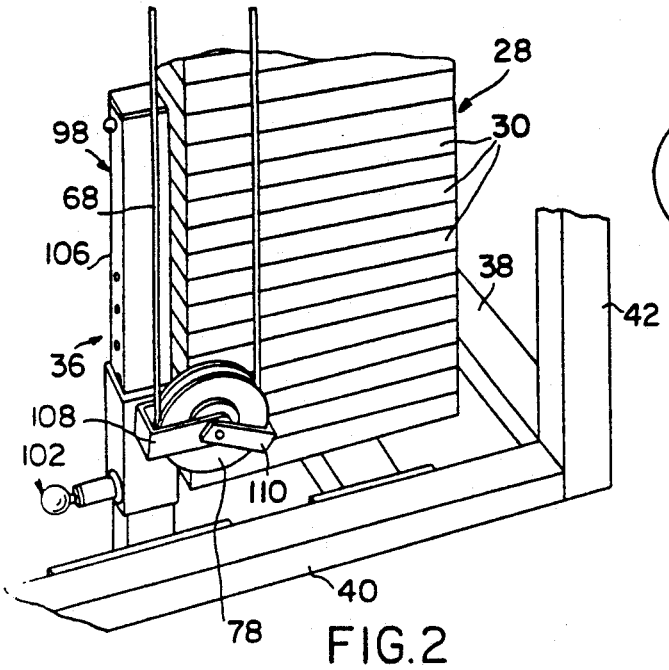
FIG. 2 is an enlarged section taken on line 2—2 in FIG. 1 and illustrates the pre-stretch adjustment means of the machine.
Figure 3:
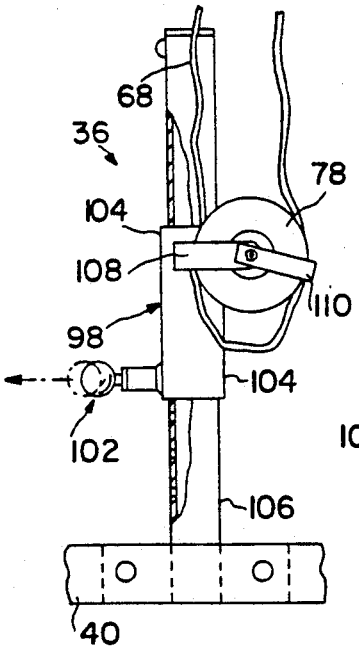
FIGS. 3 and 4 are enlarged fragmentary side elevations of the pre-stretch adjustment means in FIG. 2 showing the adjustment means in different positions of adjustment.
Figure 4:
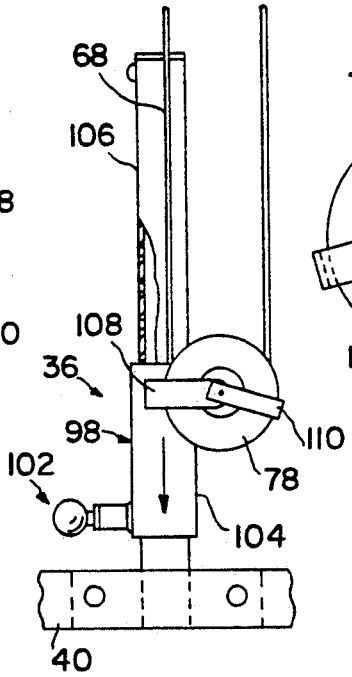
Figure 5:
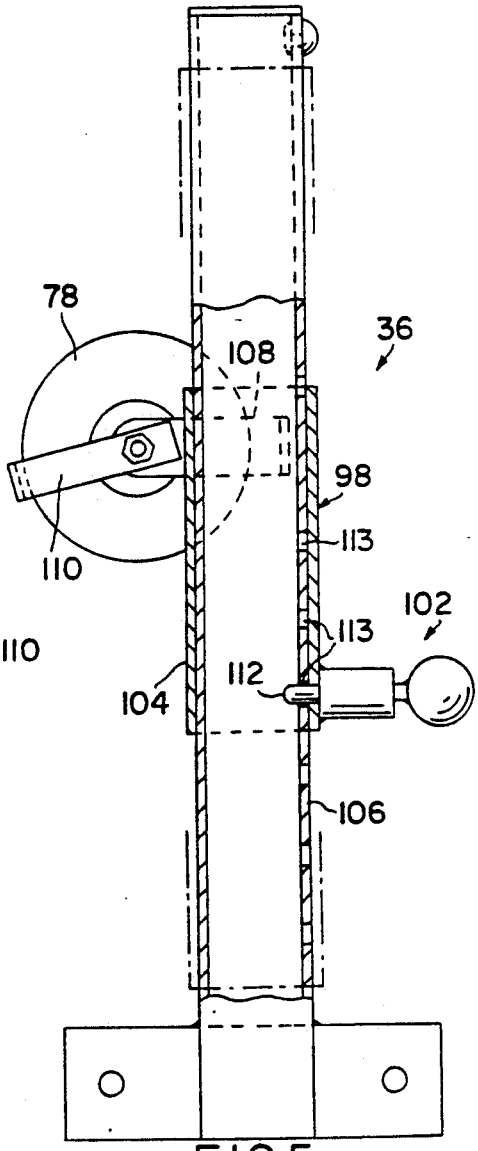
FIG. 5 is a further enlarged rear side elevation, partly in section, of the pre-stretch adjustment means as shown in FIG. 3.

Turning now to the drawings and particularly to FIGS. 1-6*a*, there is illustrated a multistation exercise machine 10 embodying the pre-stretch adjustment feature of the invention. The exercise machine 10 is similar in many respects to the exercise machine disclosed in U.S. Pat. No. 4,844,456 and has a frame 12 arranged about which are exercise stations 14 and 16. Mounted on the frame 12 at the exercise stations 14 and 16 are exercise members collectively designated by the numeral 18 for performing different exercise routines. The particular exercise members shown are the following: two pectoral fly exercise arms 20 for performing pectoral fly exercises located at exercise station 14, and a chest and shoulder press exercise arm 22 for performing chest and shoulder press exercises and a leg extension exercise arm 24 for performing a leg extension execise both located at exercise station 16. These several exercise members or arms 18 are connected by a cable system 26 to a weight 28. Weight 28 is a weight stack composed of several individual weight plates 30 including a top plate 32, and means 34 for releasibly coupling the top plate 32 to any one or more of the individual plates 30 to form a stack of desired weight.

Weight 28 is movable up and down relative to the frame 12 between a lower rest position wherein the weight rests on the frame 12 and an upper position. Each of the exercise members or arms 18 is movable in a back and forth exercise motion along a certain exercise path. The cable system 26 connects the weight 28 to the exercise members 18 in such a way that movement of each member in one direction along its exercise path, referred to herein as forward movement of the member, transmits a lifting force through the cable system from the exercise member to the weight for raising the weight from its lower rest position and transmits through the cable system from the weight back to the exercise member an opposite gravitional force which resists forward movement of the exercise member and urges the arm rearwardly toward its normal position. During rearward return movement of each exercise member along its exercise path to its normal postion, the weight 28 is returned downwardly to its rest position by gravity. Forward movement of each exercise member has a forward limit and rearward return movement of the member has a rear or return limit.

The exercise machine structure described thus far is conventional. The cable system of the conventional exercise machine is arranged in such a way that the resisting force produced by the weight 28 acts on each exercise member 18 throughout its entire back and forth exercise movement between its forward and return limits. The present improved exercise machine 10 embodies pre-stretch adjusting means 36 for adjusting the position of each exercise member 18 along its exercise path at which the resisting force of the weight 28 commences to act on the respective member and thereby the portion of the overall exercise path of the member over which the resisting force acts on the member. In the preferred multistation exercise machine of the invention, the pre-stretch adjusting means 36 effects this pre-stretch adjustment of all of the exercise members 18 simultaneously by adjusting the cable path of the cable system 26 in such a way as to remove all cable slack from or create a variable amount of cable slack in the cable system. The purpose of this pre-stretch adjustment is to enable each individual user of the machine to vary the exercise routines performed on the machine in such a way as to accommodate the various machine exercises to the user's individual exercise needs, abilities, objectives and the like.

Referring now in more detail to the drawings, the exercise machine frame 12 comprises a pair of horizontal members 38, 40 which are rigidly joined to one another at one end and disposed substantially at right angles to one another to form a supporting base for the frame. At the inner side of the corner formed by and rigidly joined to the base members 38, 40 is a base member 41. Rigidly secured at its lower end to the joined ends of the base members 38 is an upstanding frame member 42. Additional upwardly inclined frame members 44 and 46 are secured at their lower ends to the outer end of base member 38 and a midpoint of base member 40, respectively, and are joined at their upper ends to the upper end of the frame member 42 by upper horizontal frame members 48 and 50. These upper frame members 48 and 50 and the respective inclined frame members 44, 46 are disposed substantially in common vertical planes with the frame base members 38, 40, respectively. At the front sides of the upper frame members 48, 50 in FIG. 1 is a horizontal support beam 52 parallel to the upper frame member 50 and rigidly joined at one end to the upper frame member 48.

Inclined frame member 44 is located at the pectoral fly exercise station 14 of the exercise machine. Mounted on the outer side of the frame member 44 is a seat 54 and backrest 56 for supporting a person performing a pectoral fly exercise at the station 14. The pectoral fly exercise members 20 at the exercise station 14 comprise exercise arms having padded wings 57 and mounted on the inclinded frame member 44 above and at opposite sides of the seat 54 for rotation about parallel generally vertical axes. A person performing a pectoral fly exercise at the exercise station 14 places his arms against the padded wings 57 of the exercise arms 20 and rotates the exercise arms back and forth about their vertical rotation axes in the well known way.

Inclined frame members 46 are located at the chest/-shoulder press and leg extension exercise station 16. Mounted on the outer sides of the frame members 46 is a seat 58 and back rest 60 for supporting a person performing chest/shoulder or leg extension exercises at the exercise station 16. The chest/shoulder press exercise member 22 comprises an upwardly inclined arm of open frame construction pivotally mounted at its upper end on the upper frame member 50 over the seat 58 for rotation about a horizontal axis normal to the common plane of the frame members 40, 46, 50. At the lower end of the exercise arm 22 are hand grips to be grasped by a user. A person performing a chest and shoulder press exercise at the exercise station 16 grasps one set of the hand grips 62 and rotates the exercise arm 22 back and forth about it upper horizontal pivot axis in the well known way.

The leg extension exercise member 24 at the exercise station 16 comprises an arm pivotally mounted at one end on the front edge of the seat 58 for rotation on an axis parallel to that of the exercise arm 22. At the lower end of the leg extension exercise arm 24 are leg cushions 64. A person performing a leg extension exercise at the exercise station 16 engages the lower ends of his legs behind the leg cushions 64 and swings his legs back and forth in such a way as to rotate the leg extension exercise arm 24 back and forth about its upper pivot axis in the well known way.

The weight stack 28 is supported on the exercise machine frame 12 for up and down movement relative to the frame. To this end, the frame includes a pair of vertical guide rods 66 extending between and rigidly joined at their ends to the lower frame base member 41 and the upper frame beam 52. These guide rods extend slidably through guide holes in the several plates 30, 32 of the weight stack 28 so as to slidably support the plates for vertical movement relative to the frame 12.

The cable system 26 of the exercise machine 10 connects the exercise members 20, 22, 24 to the top plate 32 of the weight stack 28 in the manner described below so that movement of any one of the exercise members in its back and forth exercise motion raises and lowers the upper plate and thereby all of the lower weight plates 30 currently coupled to the top plate. Except for the pre-stretch adjustment means 36, which constitutes the major contribution of this invention, the cable system 26, and indeed the entire exercise machine described to this point, are generally conventional. With this in mind, the cable system 26 will now be described with particular reference to FIG. 6*a*.

Cable system 26 comprises a first cable 68 and a second cable 69. Cable 68 has one end 68' effectively anchored in a manner to be described presently, to the outer end of the upper machine frame member 50 and an opposite end 68'' secured to the upper plate 32 of the weight stack 28. From its end 68', the cable passes sucessively around four cable guides 70, 72, 74, 76 mounted two on the frame member 46 and two on the chest/shoulder press exercise arm 22, as shown in FIG. 1, then downwardly around an adjustable cable guide 78 on the bottom of the machine frame 12, then upwardly around a fixed cable guide 80 on the top of the frame 12, then downwardly aroung a floating cable guide 82, then upwardly around a second fixed cable guide 84 on the top of the frame 12, and finally downwardly to the top weight stack plate 32. Cable 69 has one end 69' attached to the leg extension exercise arm 24 and an opposite end 69'' attached via two cable sections 86 to the pectoral fly exercise arms 20, respectively. From its end 69', the cable 69 extends around a fixed cable guide 88 on the bottom of the machine frame 12, then upwardly around a floating cable guide 90 attached by side plates 92 to the floating cable guide 82, then downwardly around a fixed cable guide 94 on the bottom of the frame 12, and finally upwardly to the cable sections 86. These cable sections extend upwardly from the end 69'' of cable 69 and around two fixed cable guides on the frame 12 at the pectoral fly exercise station 14 and then to the pectoral fly exercise arms 20, respectively. The preferred cable guides illustrated are pulleys.

Figure 6:
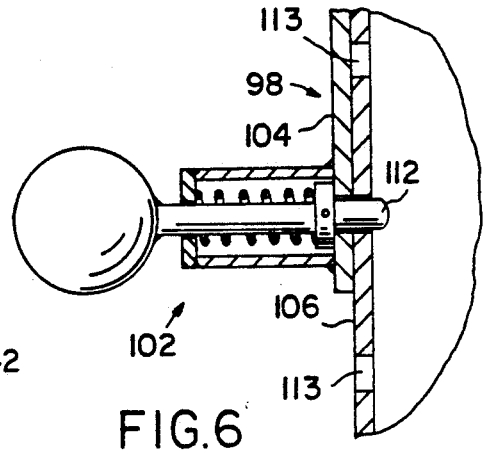
FIG. 6 is a still further enlarged section through a lock pin embodied in the pre-stretch adjustment means of FIGS. 2-5.
Figure 6A:
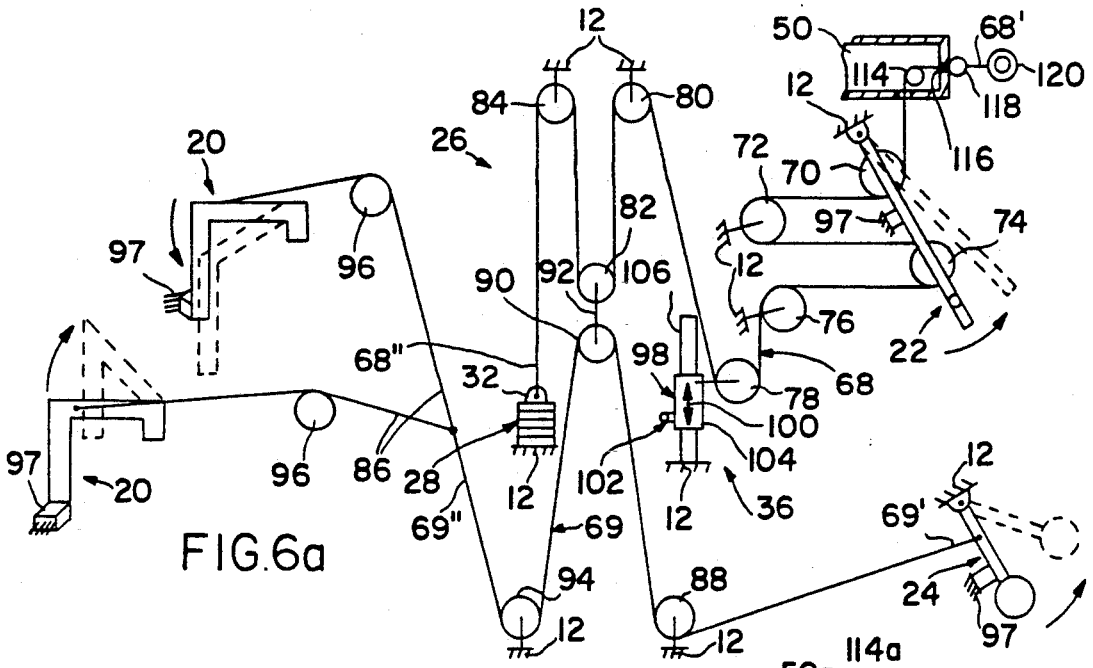
FIG. 6A is a diagrammatic illustration of the exercise machine of FIGS. 1-6.

Assume now that the exercise arms 20, 22, 24 are rotatable between fixed limiting positions, hereafter referred to as normal positions, shown in solid lines and and other positions shown in broken lines in FIG. 6*a* and that all of the plates 30 of the weight stack 28 are coupled to its upper plate 32. Assume further that the exercise arms occupy their solid line normal positions, that the weight stack occupies its lower solid rest position in FIG. 6*a* wherein the stack rests on the bottom of the machine frame 12, and that the cables 68, 69 are in a relaxed state substantially devoid of both slack and tension. Under these conditions, during forward rotation of any one of the exercise arms 22, 24, 26 from its solid line normal position toward its broken line position, the cable system 26 transmits a lifting force from the rotated arm to the weight stack 28 which raises the stack from its lower rest position and transmits an opposite gravitational force from the weight stack back to the rotated arm which resists forward rotation of the arm and urges or biases the arm rearwardly to its solid line position.

For example, assume first that the pectoral fly exercise arms 20 are rotated forwardly from their solid line limiting or normal positions toward their broken line positions. The cable system 26 is arranged in such a way that this forward rotation of the arms 20 exerts a pulling force on the end 69'' of cable 69 through the cable sections 86. The opposite end 69' of cable 69 is fixed by virtue of its attachment to the leg extension exercise arm 24 which currently occupies its solid line limiting or normal position. The end 68' of cable 68 is fixed to the frame member 50. Accordingly, the pulling force exerted on the cable 69 by rotation of the pectoral fly exercise arms 20 produces a downward force on the floating pulleys 82, 90 of the cable system and thereby on the loop portion of the cable 68 between the two upper pulleys 80, 84 which is engaged by the upper floating pulley 82. Since the end 68' of cable 68 is fixed, this downward force on the cable 68 produces an upward lifting force at the end 68" of the cable which raises the weight stack 28 from its lower rest postion. A gravitational force is thereby transmitted through the cable to its end 69" which resists rotation of the exercise arms 20 from their solid line normal positions to their broken line positions and tends to return the arms rearwardly back to their normal positions. During rearward return of the exercise arms 20 to their normal positions, the weight stack 28 is returned downwardly to its rest postion by gravity.

Similarly, forward rotation of the chest/shoulder press exercise arm 22 from its solid line fixed limiting or normal position toward its broken line position with the pectoral fly exercise arms 20 and leg extension exercise arm 24 stationary in their solid line fixed limiting positions transmits an upward lifting force through the cable 68 to the weight stack 28 which raises the stack from its lower rest postion. An opposing gravitational force is thereby transmitted back through the cable 68 to the exercise arm 24 which resists forward rotation of the arm from its normal position to its broken line position and tends to return the arm rearwardly back to its normal position. During rearward return of the exercise arm 24 to its normal position, the weight stack 28 is returned downwardly to its rest position by gravity. Forward rotation of the leg extension exercise arm 24 from its solid line fixed limiting or normal position toward its broken line position with the chest/shoulder press exercise arm 22 and pectoral fly exercise arms 20 stationary in their solid line fixed limiting positions transmits a lifting force through the cables 69, 68 to the weight stack 28 which raises the stack from its lower rest position. An opposing gravitational force is thereby transmitted back through the cables to the leg extension exercise arm 24 which resists forward rotation of the arm and urges the arm rearwardly toward its normal position. The weight stack 28 is returned to its lower rest position by gravity during return rotation of the exercise arm 24 to its normal position.

From the foregoing description, it will be understood that during back and forth exercise movement or rotation of any one of the exercise arms 20, 22, 24 while the other exercise arms remain stationary in their solid line positions, the cable system 26 transmits a lifting force from the rotated arm to the weight stack 28 during rotation of the arm in a forward direction from its solid line normal position to its broken line position and transmits a corresponding resisting force to the rotated arm which resists forward rotation of the arm and tends to return the arm rearwardly to its normal position. The exercise machine frame 12 and the exercise arms 20, 22, 24 include coacting stop means schematically illustrated at 97 in FIG. 6*a*, for positively limiting return rotation of the arms to their solid line limiting or normal positions.

Under the conditions stated above, the resisting force exerted by the weight stack 28 on each exercise arm 20, 22, 24 commences to act on the arm immediately upon forward rotation of the arm from its normal position and continues to act on the arm throughout its entire back and forth exercise movement or rotation between its normal position and the forward limiting position of the arm. As noted earlier, it is desireable to permit each individual user of the exercise machine to vary the exercise routine performed with each exercise arm 20, 22, 24 by adjusting the position of the arm along its exercise path at which the resisting force produced by the weight stack 28 commencences to act on the arm and thereby also the portion of the exercise path over which the resisting force acts on the arm. The pre-stretch adjustment means 36 of this invention permits such adjustment and will now be described.

Simply stated, the pre-stretch adjustment means 36 of the invention comprises means for adjusting the cable path of the cable system 26 in such a way as to vary the cable slack in the cable system from a minimum slack condition of essentially zero cable slack and zero cable tension and a maximum slack condition when the exercise arms 20, 22, 24 occupy their solid line normal positions of FIG. 6*a*. Adjustment the cable slack between these minimum and maximum slack conditions adjusts the positions of the exercise arms 20, 22, 24 along their exercise paths at which the cable means of the cable system becomes sufficiently taut during forward movement or rotation of any one of the arms along its exercise path to transmit lifting and resisting forces between the rotated exercise arm and the weight stack 28. According to the preferred practice of the invention, this cable path pre-stretch adjustment is accomplished by adjusting one pulley of the cable system about which passes a cable that transmits the lifting and resisting forces between all of the exercise arms 20, 22, 24 and the weight stack 28. In the particular exercise machine 10 illustrated in FIGS. 1–6*a*, the cable and pulley utilized for the pre-stretch adjustment are the cable 68 and pulley 78.

To this end, the pre-stretch adjustment means 36 comprises means 98 mounting the pre-stretch adjustment pulley 78 on the machine frame 12 for movement of the pulley relative to the frame along a direction line 100 such that the tension produced in the cable 68 by the lifting and resisting forces transmitted through the cable urges the pulley in one direction along the direction line. The pre-stretch adjustment means further comprises means 102 for securing pulley 78 against movement along the direction line by the cable tension when the pulley is disposed in certain positions along the direction line. Adjustment of the pulley 78 along the direction line 100 is effective to adjust the cable system 26 between the above-described minimum and maximum slack conditions when the exercise arms 20, 22, 24 occupy their solid line normal positions of FIG. 6*a*. The position of the pulley 78 along the direction line 100 thus determines the forward movement or rotation, if any, of each exercise arm along its exercise path from its normal position neccessary to eliminate any slack in the cable 68*a* and thereby transmit lifting and resisting forces through the cable system 26 between the weight stack 28 and the rotated exercise arm.

The pulley mounting means 98 comprises a pulley guide 104 in the form of a slide on an upstanding guide bar 106 parallel to the direction line 100 and rigidly secured to the frame base member 40. The pre-stretch adjustment pulley 78 is rotatably supported in a mounting bracket 108 which is welded or otherwise firmly joined to the guide 104. A U-shaped cable retaining bracket 110 is secured to the mounting bracket and extends about the edge of the pulley 78 to retain the cable 68 on the pulley when the cable is slack. Adjustment of the guide 104 along the guide bar 106 is effective to adjust the slack in the cable 68 and hence in the cable system 26 as a whole, between the minimum and maximum cable slack conditions described above. The pre-stretch adjustment stop means 102 comprises a spring loaded detent or stop pin 112 on the guide 104 which is selectively engagable in holes 113 spaced along the guide bar 106. From this description, it will be understood that the guide 104 may be locked in any one of several different positions along its guide bar 106, as shown in FIGS. 2–5, to adjust the position along the exercise path of each exercise member or arm 20, 22, 24 at which the resisting force of the weight stack 28 commences to act on the respective arm during forward movement or rotation of the arm from its solid line normal position and thereby the portion of the exercise path over which the resisting force acts during back and forth exercise motion of the arm. When the guide is locked in its lower position of FIGS. 2 and 4, the resisting force commences to act on each exercise arm immediately upon forward rotation of the arm from its normal position and hence throughout the entire exercise motion of the arm.

As mentioned earlier, the end 68' of cable 68 is anchored to the outer end of the upper frame member 50. So far as the exercise machine described to this point is concerned, it is immaterial how this cable end is anchored. In the particular exercise machine illustrated, however, the cable end 68' extends around a pulley 114 and then outwardly through a hole 116 in the end of the frame member 50. A stop 118 is fixed on the outer extremity of the cable to block inward passage of the cable extremity through the hole 116. At the outer extremity of the cable 68 is a coupling 120 for attaching an additional exercise member, such as a bar, (not shown) to the cable for performing an additional exercise routine involving pulling the additional member back and forth while the other exercise members or arm 22, 24, 26 remain stationary in their solid line normal positions. It is evident from the description to this point that this back and forth movement of the additional exercise member raises and lowers the weight stack 28 which thus exerts a resisting force on the additional member.

Figure 8A:
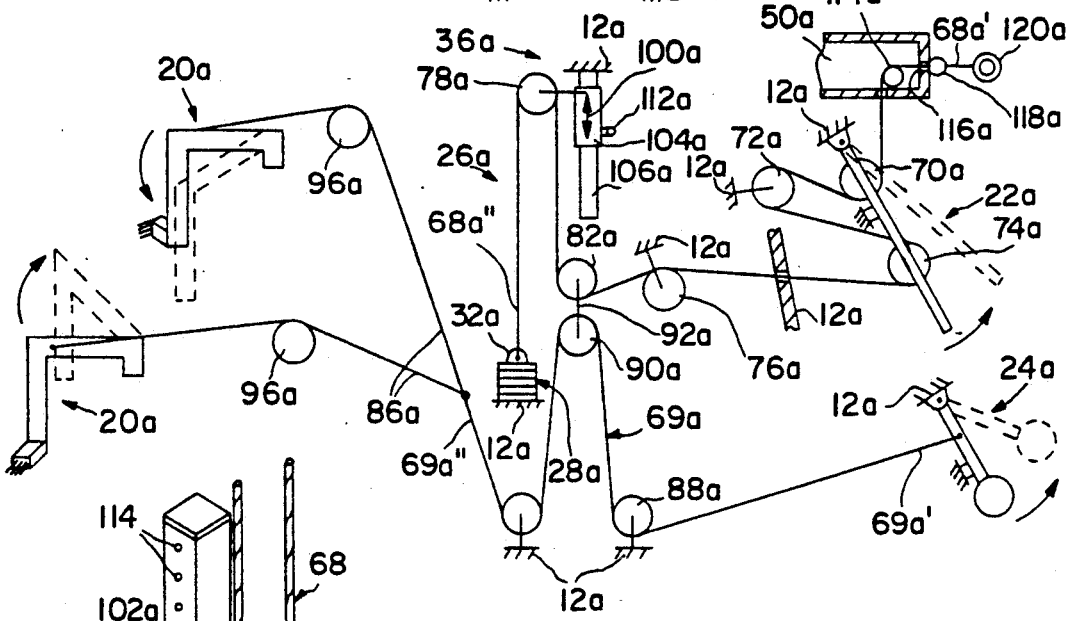
FIG. 8*a* is a diagrammatic illustration of the exercise machine of FIGS. 7 and 8.
Figure 7:
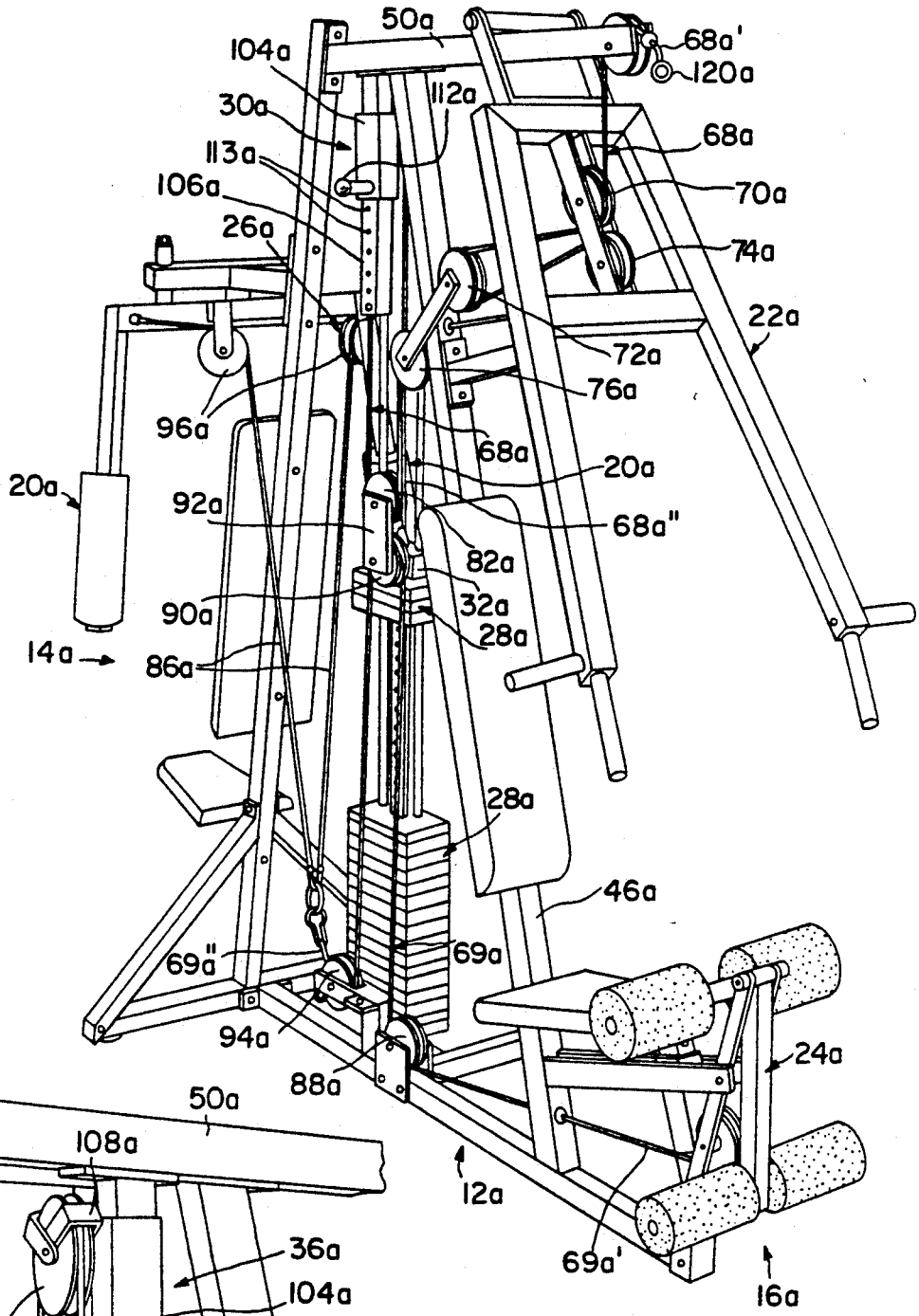
FIG. 7 is a perspective view of an exercise machine embodying a modified pre-stretch adjustment means according to the invention.
Figure 8:
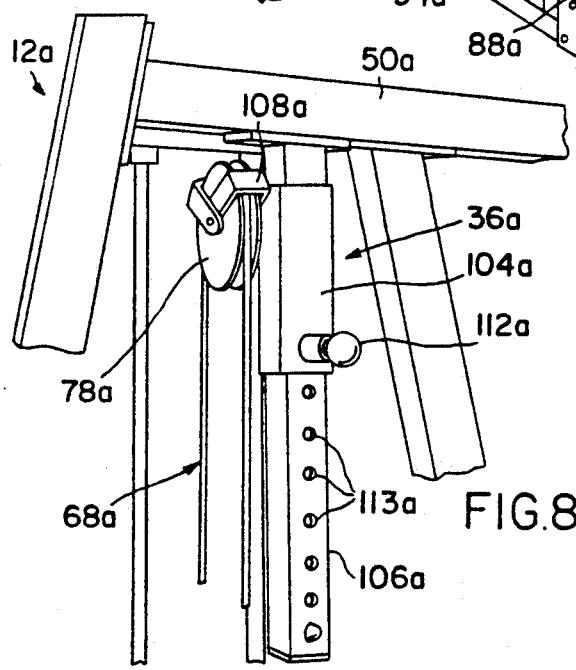
FIG. 8 is an elarged fragmentary view illustrating the modified pre-stretch adjustment means of the exercise machine in FIG. 7.

The modified exercise machine 10*a* of FIGS. 7–8*a* is very similar and indeed essentially identical to that of FIGS. 1–6*a* except for certain minor differences in the construction of the machine frame 12*a* and a different arrangement of the cable system 26*a* and pre-stretch adjustment means 36*a* of the modified machine. Accordingly, there is no need for an elaborate description of the modified exercise machine except for its cable system 26*a* and pre-stretch adjustment means 36*a*. Concerning the modified machine frame 12*a*, suffice it to say that its two exercise stations 14*a* and 16*a* are located diametrically opposite one another rather that at right angles to one another as they are in the exercise machine of FIGS. 1–6*a* and that the machine frame 12*a* is modified accordingly.

Referring particlularly to FIG. 8*a*, the modified cable system 26*a* comprises a first cable 68*a* and a second cable 69*a*. Cable 68*a* has one end 68*a'* anchored to the outer end of the upper machine frame member 50*a* in the same manner as the end 68' of cable 68 in FIGS. 1–6*a*. Cable 68*a* has an opposite end 68*a''* secured to the upper plate 32*a* of the weight stack 28*a*. From its end 68*a'*, the cable 68*a* passes sucessively around four cable guides 70*a*, 72*a*, 74*a*, 76*a* mounted two on the chest/-shoulder press exercise arm 22*a* and two on the inclined frame member 46*a*, then downwardly around an upper floating cable guide 82*a*, then upwardly are an adjustable, pre-stretch adjustment cable guide 78*a* at the top of frame 12*a*, and finally downwardly to the top weight stack plate 32*a*. Cable 69*a* has one end 69*a'* attached to the leg extension exercise arm 24*a* and an opposite end 69*a''* attached via two cable sections 86*a* to the pectoral fly exercise arms 20*a*, respectively. From its end 69*a'*, the cable 69*a* extends around a fixed cable guide 88*a* on the bottom of the machine frame 12*a*, then upwardly around a lower floating cable guide 90*a* attached by side plates 92*a* to the upper floating cable guide 82*a*, then downwardly around a fixed cable guide 94*a* on the bottom of the frame 12*a*, and finally upwardly to the cable sections 86*a*. These cable sections extend upwardly from the end 69*a''* of cable 69*a* and around two cable guides 96*a* on the frame 12*a* at the pectoral fly exercise station 14*a* and then to the pectoral fly exercise arms 20*a*, respectively. The preferred cable guides illustrated are pulleys as in the exercise machine 10.

The pre-stretch adjustment pulley 78*a* is mounted in a bracket 108*a* firmly secured to a guide 104*a* slidable on a guide bar 106*a* for adjustment of the pulley along the guide bar. Guide bar 106*a* is vertically disposed and fixed at its upper end to the machine frame 12*a* in the manner best illustrated in FIG. 8. Adjustment of the pre-stretch adjustment guide 104*a* along the guide bar 106*a* adjusts the cable slack in the cable system 26*a* in the same manner as adjustment of the pre-stretch adjustment pulley 78 in FIGS. 1–6*a*. The guide is retained in adjusted position by engagement of a spring loaded detent or pin 112*a* on the guide in holes 113*a* in the guide bar 106*a*.

It is evident from the preceding description and the drawings that the modified exercise machine 10*a* is used in the same way and to perform the same exercise routines as the exercise machine 10. Accordingly, it is unneccessary to describe the operation of the modified machine in elaborate detail. Suffice it to say that during forward rotation of any one of the exercise arms 20*a*, 22*a*, 24*a* from its normal position, the cable system 26 transmits a lifting force from the rotated arm to the weight stack 28*a* which raises the stack from its lower rest position and transmits from the weight stack back to the rotated arm an opposite gravitational force which resists forward rotation of the arm and urges or biases the arm rearwardly toward its normal position. The slack in the cables 68*a*, 69*a* is adjustable between the same minimum and maximum slack conditions described earlier in connection with the exercise machine 10 by ajustment of the pre-stretch adjustment pulley 78*a* along its guide bar 106*a*, thereby to adjust the positions along the exercise paths of the exercise arm at which the resisting force of the weight stack commences to act on the exercise arms.

Figure 9:
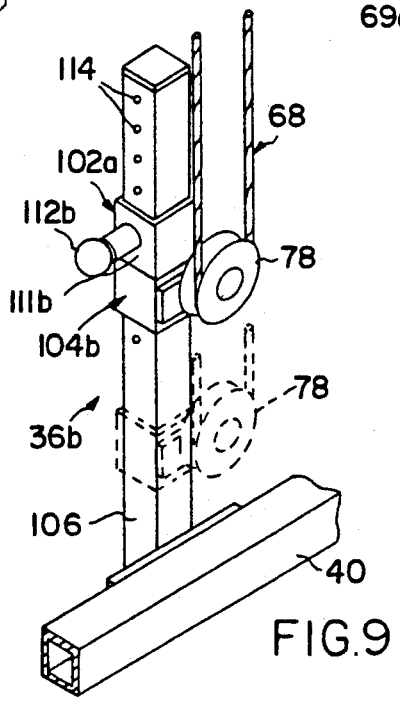
FIG. 9 is a fragmentary perspective view of a further modified pre-stretch adjustment means according to the invention.

FIG. 9 illustrates a modified pre-stretch adjustment means 36*b* for the exercise machine in FIGS. 1–6*a*. The rest of the exercise machine utilizing the modified pre-stretch adjustment means of FIG. 9 is identical to that of FIGS. 1–6*a* and for this reason is not shown in FIG. 9. In this modified adjustment means, the pre-stretch adjustment pulley 78 is mounted on guide 104*b* in the form of a weighted slide that is freely slidable on the guide bar 106. Guide 104*b* is uged upwardly by the tension in the cable 68 which passes around the pulley and downwardly by gravity. Above the guide 104*b* are means 102*a* for securing the guide against upward movement by the cable tension when the guide occupies certain positions spaced along the guide bar. Securing means 102*a* comprises a stop sleeve 111*b* slidable on the guide bar 106 above the pulley guide 104*b* and a spring loaded detent or pin 112*b* on the sleeve engagable in the holes 114 spaced along the guide bar. In this pre-stretch adjustment means 36*b*, the stop sleeve 111*b* is set in accordance with the pre-stretch adjustment desired, and gravity is utilized to take up any slack in the cable 68 when the machine is not in use. During use of the machine, forward movement or rotation of any one of the exercise members or arms 20, 22, 24 (not shown in FIG. 9) removes slack, if any, existing in the cable 68 and raises the pulley guide 104*b* into contact with the stop sleeve 111*b*. At this point, lifting and resisting forces are transmitted through the cable to the weight stack 28 (not shown in FIG. 9) and to the rotated exercise arm in the manner explained.

The inventor claims:

1. A method of exercising with an exercise apparatus having a frame, a weight selectively displaceable from a rest position, a cable system coupled to the weight and including at least one cable, an exercise member coupled to the cable and moveable along an exercise path to selectively lift the weight from the rest position along at least a portion of the exercise path, and means coupled to the cable system for maintaining the cable in a slack-free condition, said method comprising the steps of:

(a) providing a hand operated adjustment means for adjusting a cable path of the cable system;

(b) setting the adjustment means to select a position of the exercise member along the exercise path at which the weight commences to act on the exercise member;

(c) moving the exercise member through a first portion of the exercise path wherein the cable remains in the slack-free condition and the weight remains in the rest position;

(d) continuing to move the exercise member through a second portion of the exercise path wherein the weight is lifted from the rest position and the cable is tensioned thereby.

2. A method of exercising with an exercise apparatus having a frame, a weight selectively displaceable from a rest position, a cable system coupled to the weight and including at least one cable, a press arm coupled to the cable and pivotally coupled to the frame for movement along an exercise path to selectively lift the weight from the rest position along at least a portion of the exercise path, said method comprising the steps of:

(a) providing a hand operated adjustment means for adjusting a cable path of the cable system;

(b) setting the adjustment means to select a position of the press arm along the exercise path at which the weight commences to act on the press arm;

(c) moving the press arm through a first portion of the exercise path wherein the weight remains in the rest position;

(d) continuing to move the press arm through a second portion of the exercise path wherein the weight is lifted from the rest position.

* * * * *